United States Patent [19]

Barrowman et al.

[11] 4,307,907

[45] Dec. 29, 1981

[54] POSITIONING DEVICE FOR VEHICLE CLOSURE MEMBER

[75] Inventors: Thomas Barrowman, Warren; Donald S. Bartlett, Troy; Theodore J. Beaulieu, Warren, all of Mich.

[73] Assignee: General Motors Corporation, Detroit, Mich.

[21] Appl. No.: 153,035

[22] Filed: May 27, 1980

[51] Int. Cl.[3] ..... E05C 17/54

[52] U.S. Cl. ..... 292/339; 292/DIG. 43; 292/DIG. 49

[58] Field of Search ..... 292/263, 288, 338, 339, 292/DIG. 43, DIG. 49

[56] References Cited

U.S. PATENT DOCUMENTS

| | | | |
|---|---|---|---|
| 3,093,258 | 6/1963 | Turner | 292/263 X |
| 3,992,070 | 11/1976 | Dunn et al. | 292/263 X |
| 4,070,050 | 1/1978 | Glock et al. | 292/339 |
| 4,124,240 | 11/1978 | Adelberg | 292/339 X |
| 4,139,227 | 2/1979 | Spurr | 292/339 |
| 4,157,128 | 6/1979 | Peters | 292/339 X |
| 4,231,599 | 11/1980 | Gayman | 292/339 |

*Primary Examiner*—Richard E. Moore

*Attorney, Agent, or Firm*—Edward J. Biskup

[57] ABSTRACT

A positioning device for selectively maintaining a vehicle closure member in an opened position and a closed position and including four pivotally interconnected link members which work in pairs for locking the closure member in the opened and closed positions.

2 Claims, 7 Drawing Figures

POSITIONING DEVICE FOR VEHICLE CLOSURE MEMBER

This invention concerns a positioning device for a closure member and more particularly a positioning device for selectively maintaining the rear compartment deck lid of a vehicle in an opened position and in a closed position.

At one stage in the manufacture of a passenger vehicle, the sheet metal body passes through a spray booth at which time it is painted by automatic as well as manually operated spray guns. During the painting operation, the rear compartment deck lid is closed and afterwards opened so that the outer and inner surfaces of the deck lid can be painted. Presently, it is the practice to rely on the spring or torque rods associated with the deck lid to maintain the latter in the opened position. It is also the practice to rely on the deck lid key lock for holding the deck lid in the closed position. Although this method of holding the deck lid in the opened and closed positions is acceptable when used with the present spraying techniques, it cannot provide the positioning accuracy required when the vehicle body is being painted by a multi-axis robot such as can be seen in co-pending patent application U.S. Ser. No. 061,506, filed on July 27, 1979, in the name of James C. Perry and assigned to the assignee of this invention.

Accordingly, the objects of the present invention are to provide a new and improved positioning device for the rear compartment deck lid of a vehicle for selectively maintaining the deck lid in an opened position and in a closed position; to provide a new and improved positioning device that has a plurality of pivotally interconnected link members two of which assume an over-center position when the positioning device holds the deck lid in an opened position and another two of which assume an over-center position when the positioning device holds the deck lid in a closed position; and to provide a new and improved positioning device for selectively holding a vehicle rear compartment deck lid opened and closed during a painting operation and in which a pair of pivotally interconnected link members are located in parallel side by side relationship when the deck lid is held closed by the positioning device and the same pair of link members are longitudinally aligned one above the other when the deck lid is held opened by the positioning device.

The above objects and others are accomplished, in accordance with the invention, by a positioning device which is combined with a vehicle rear compartment deck lid that is hinged at its forward edge for movement about a horizontal axis. In the preferred form, the positioning device is adapted to selectively maintain the deck lid in an opened position and a closed position relative to a fixed support portion of the vehicle and includes first and second link members connected to each other for relative pivotal movement about a first pivot axis. In addition, third and fourth link members are provided which are respectively connected to the first and second link members for pivotal movement about second and third pivot axes located adjacent to the first pivot axis. The third and fourth link members are connected to each other for pivotal movement about a fourth pivot axis, and the arrangement is such that when the deck lid is in the closed position, the free ends of the first and second link members are connected to the deck lid and to the support portion of the vehicle, respectively. In the closed position of the deck lid, the first and second link members are located in substantially parallel relationship along a substantially horizontal axis and the third and fourth link members are longitudinally aligned along a substantially vertical axis. When the deck lid is moved from the closed position to the opened position, the first and second link members are longitudinally aligned, one above the other, along a substantially vertical axis and the third and fourth link members are substantially normal to each other. When the positioning device is maintaining the deck lid in the closed position, the third and fourth link members assume an over-center position; and when the positioning device is maintaining the deck lid in the opened position, the first and second link members assume an over-center position. Thus, in this manner, the positioning device serves to positively hold the deck lid in the opened and closed positions.

A more complete understanding of the present invention will be derived from the following detailed description, when taken in conjunction with the drawings, in which.

Figure 1:
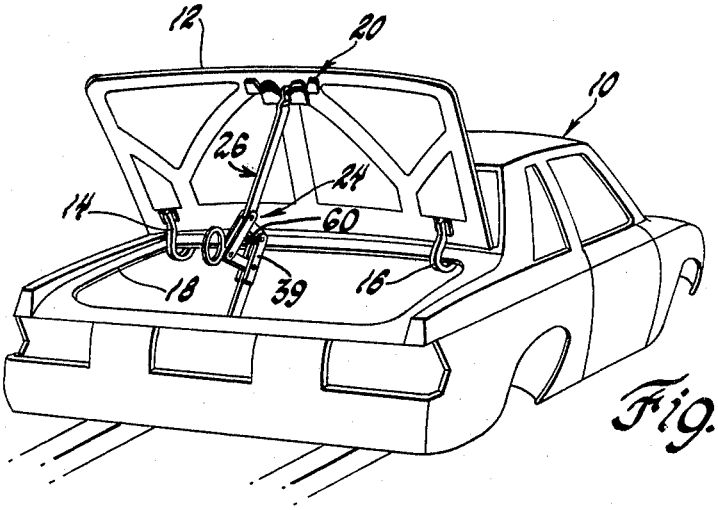
FIG. 1 is a perspective view showing a vehicle body being carried along a conveyor track and having the rear compartment deck lid thereof maintained opened by a positioning device made in accordance with the invention.
Figure 2:
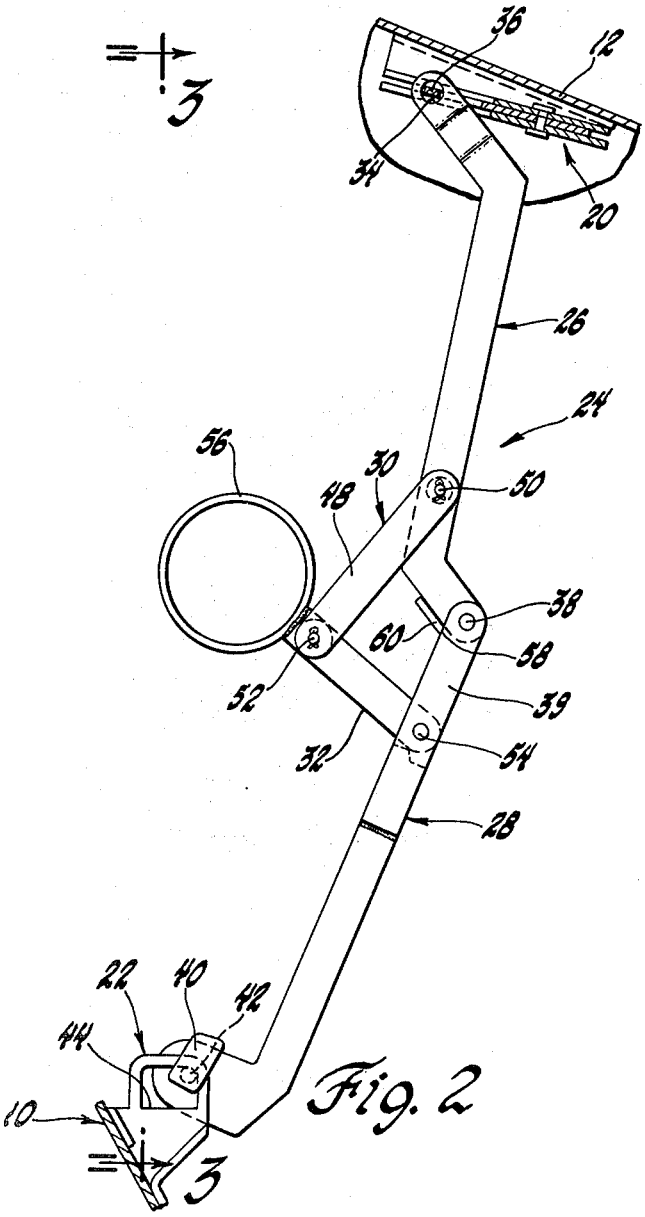
FIG. 2 is an enlarged side elevational view of the positioning device incorporated with the vehicle body shown in FIG. 1.
Figure 3:
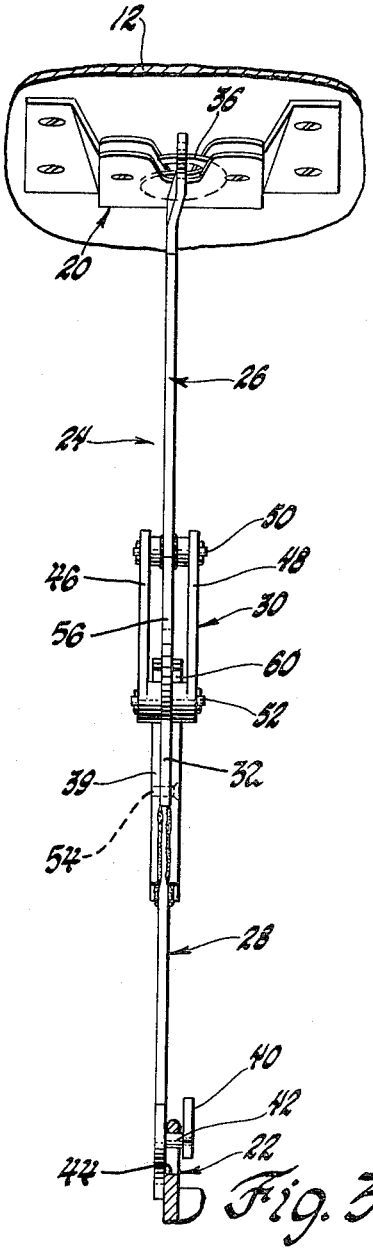
FIG. 3 is an end view of the positioning device taken on line 3—3 of FIG. 2.
Figure 4:
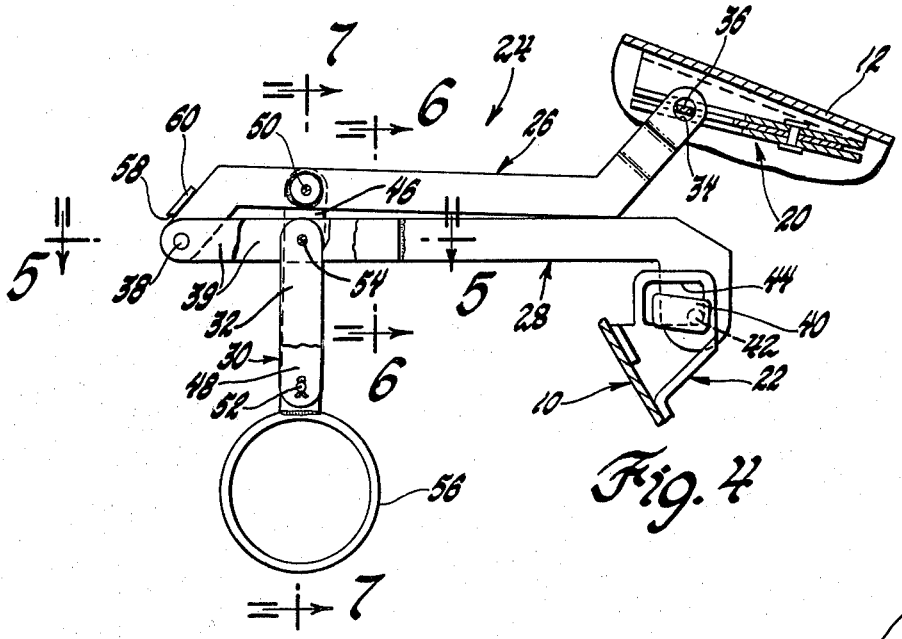
Figure 5:
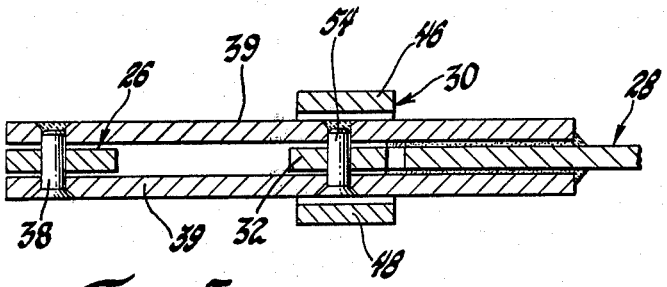
Figure 6:
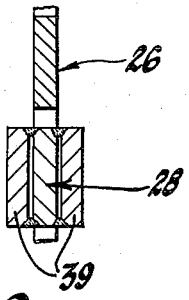
Figure 7:
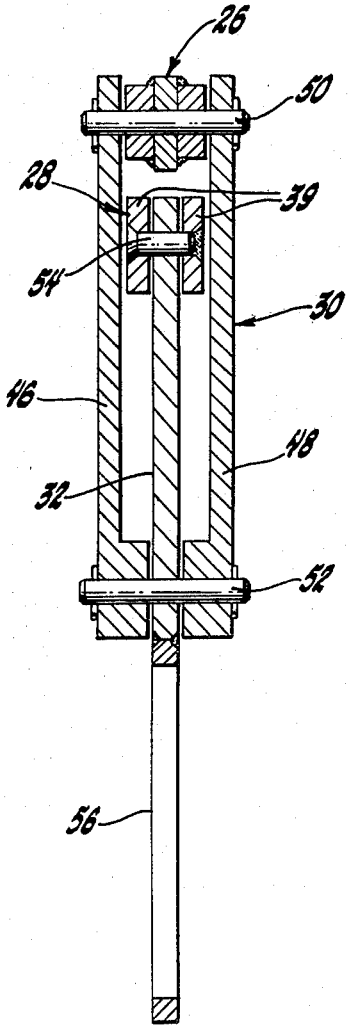

FIG. 4 is a view of the positioning device of FIGS. 1–3, maintaining the deck lid in a closed position; and FIGS. 5, 6, and 7 are enlarged sectional views taken on lines 5—5, 6—6, and 7—7, respectively, of FIG. 4.

Referring now to the drawings and more particularly to FIG. 1 thereof, a vehicle body 10 is shown being transported along a pair of floor-mounted conveyor rails prior to entering a spray booth (not shown) during the manufacture of the vehicle. As is customary, the rear compartment portion of the vehicle body 10 is provided with a deck lid or closure member 12 which is shown in the opened position and connected to the support structure of the vehicle body 10 by a pair of laterally spaced hinge straps 14 and 16. The hinge straps 14 and 16 allow the deck lid 12 to pivot downwardly about a horizontal axis into a closed position to close the opening 18 leading into the rear compartment portion of the vehicle body 10. It will also be noted that the rear end of the deck lid 12 is provided with a latch 20 which cooperates with a striker 22 fixed to the vehicle body 10, as seen in FIG. 2, for locking the deck lid 12 in position when the latter is closed.

As seen in FIG. 1, the deck lid 12 is maintained in an opened position by a positioning device 24 made in accordance with the present invention and which accurately locates the deck lid 12 so as to allow a multi-axis robot to spray the inner surface of the deck lid 12. As best seen in FIGS. 2 through 7, the positioning device 24 includes four link members 26, 28, 30, and 32 which are pivotally interconnected and arranged so that the link members 26 and 28 assume an over-center position when the deck lid 12 is being maintained in the opened position, and the link members 30 and 32 assume an over-center position when the deck lid 12 is being maintained in the closed position.

More specifically and as seen in FIGS. 2 and 3, the link member 26 has the upper end thereof provided with a circular opening 34 which is adapted to accommodate the hook member 36 incorporated with the latch 20. The lower end of the link member 26 is connected by a pivotal connection 38 to a clevis portion 39 formed rigidly with the upper end of the link member 28, while the lower end of the latter member is rigidly formed with a tongue portion 40 which is mounted on a horizontal pin 42 rigid with the link member 28. The tongue portion 40 is adapted to be located within an opening 44 formed in the striker 22 that is rigidly attached to the structure of the vehicle body 10.

The link member 30 consists of a pair of bar-like elements 46 and 48 located on the opposite sides of the link member 26 and pivotally connected at one end thereof to the link member 26 by a transversely extending pin 50. The opposite ends of the elements 46 and 48 are similarly located on the opposite sides of and pivotally connected to the link member 32 by a transversely extending pin 52. Finally, it will be noted that the link member 32 has one end thereof connected to the link member 28 intermediate the ends thereof by a pivotal connection 54. The opposite end of the link member 32 is rigidly formed with a ring 56 for a purpose which will be explained hereinafter.

The positioning device 24 described above is mounted to the vehicle body 10 by first holding the positioning device 24 in a substantially horizontal plane and having the tongue portion 40, rigidly formed with the lower end of the link member 28, inserted into the opening 44 in the striker 22 and then rotated 90° so as to, in effect, lock the tongue portion 40 to the striker 22, as shown in FIGS. 2 and 3. Afterwards, the upper end of the link member 26 is placed within the latch 30 and the hook member 36 is caused to rotate through the opening 34 and assume the position shown in FIG. 3 so as to maintain the upper end of the link member 28 securely within the latch 20. The ring 56 of the link member 32 is then moved inwardly towards the hinge straps 14 and 16 resulting in pivotal connection 38 moving in the same direction until a stop surface 58, formed with a stop member 60 rigid with the link member 26, engages the side portion of the clevis portion 39 of the link member 28. At this point, the positioning device 24 is in the fully extended position of FIGS. 2 and 3 for maintaining the deck lid 12 in the opened position shown in FIG. 1. It will be noted that in this position of the positioning device 24, the pivotal connection 38 is located to the right of a straight line passing through the centers of the circular opening 34 in the upper end of the link member 26 and the pin 42 which supports the tongue portion 40. Accordingly, the link members 26 and 28 are in an over-center position preventing the deck lid 12 from closing.

In the opened position of the deck lid 12, the inner surface of the latter will be painted, after which the ring 56 attached to the link member 32 is raised upwardly and at the same time drawn outwardly relative to the hinge straps 14 and 16 so as to cause the positioning device 24 to fold and assume the position shown in FIG. 4. As seen in FIG. 2, during the folding movement of the positioning device 24, link member 28 rotates in a counterclockwise direction about the pin 42 located within the striker 22. At the same time, the lower end of the link member 26 rotates in a clockwise direction about the hook member 36 of the latch 20 thereby causing the pivotal connection 38 to move outwardly relative to the hinge straps 14 and 16 under the control of the link members 30 and 32. As this folding movement continues, the upper end of the link member 26 draws the deck lid downwardly into the closed position shown in FIG. 4, at which time the link members 26 and 28 are located in side-by-side relationship extending along a generally horizontal axis. The link members 30 and 32, on the other hand, are aligned along a vertical axis with the pivotal connection 54 being located to the left of a straight line passing through the centers of pins 50 and 52. As a result, the link members 30 and 32 assume an over-center position which again locks the positioning device 24 so as to maintain the deck lid 12 in the closed position. After the top outer surface of the deck lid 12 is painted, the ring 56 is rotated to the left about the pivotal connection 54 so as to unlock the positioning device 24 and allow the latter to unfold to facilitate the removal thereof from the vehicle body 10.

Various changes and modifications can be made in this construction without departing from the spirit of the invention. Such changes and modifications are contemplated by the inventors and they do not wish to be limited except by the scope of the appended claims.

The embodiments of the invention for which an exclusive property or privilege is claimed are defined as follows:

1. A positioning device for use with a vehicle closure member hinged at its forward edge for movement about a horizontal axis, said positioning device adapted to selectively maintain said closure member in an opened position and a closed position relative to a fixed support portion of the vehicle and including first and second link members; means connecting said first and second link members to each other for relative pivotal movement about a first pivot axis; third and fourth link members; means connecting said third and fourth link members respectively to said first and second link members for pivotal movement about second and third pivot axes located adjacent to said first pivot axis; means connecting said third and fourth link members to each other for pivotal movement about a fourth pivot axis, the free ends of said first and second link members adapted to be connected respectively to said closure member and to said support portion so when said closure member is in said closed position said first and second link members are in substantial parallel relationship to each other along a substantially horizontal axis and said third and fourth link members are longitudinally aligned along a substantially vertical axis and when said closure member is in said opened position, said first and second link members are longitudinally aligned one above the other along a substantially vertical axis.

2. A positioning device for use with a vehicle rear compartment deck lid hinged at its forward edge for movement about a horizontal axis, said positioning device adapted to selectively maintain said deck lid in an opened position and a closed position relative to a fixed support portion of the vehicle and including first and second link members, means connecting said first and second link members to each other for relative pivotal movement about a first pivot axis; third and fourth link members, means connecting said third and fourth link members respectively to said first and second link members for pivotal movement about second and third pivot axes located adjacent to said first pivot axis, means connecting said third and fourth link members to each other for pivotal movement about a fourth pivot axis, the free ends of said first and second link members adapted to be connected respectively to said deck lid and to said support portion so when said deck lid is in said closed position said first and second link members are in substantial parallel relationship to each other along a substantially horizontal axis and said third and fourth link members are longitudinally aligned along a substantially vertical axis with said fourth pivot axis over-center, and when said deck lid is in said opened position, said first and second link members are longitudinally aligned one above the other along a substantially vertical axis with said first pivot axis over-center and said third and fourth link members substantially normal to each other.

* * * * *